United States Patent [19]

Santilli

[11] Patent Number: 5,014,090

[45] Date of Patent: May 7, 1991

[54] METHOD AND APPARATUS FOR IMPROVING A MULTI-COLOR ELECTROPHOTOGRAPHIC IMAGE USING VAPOR FUSING

[75] Inventor: Domenic Santilli, Webster, N.Y.

[73] Assignee: Eastman Kodak Company, Rochester, N.Y.

[21] Appl. No.: 500,430

[22] Filed: Mar. 28, 1990

[51] Int. Cl.[5] ..... G03G 15/01; G03G 21/00

[52] U.S. Cl. ..... 355/256; 355/215; 355/327; 430/45; 430/97; 430/117; 430/132

[58] Field of Search ..... 118/645, 652; 355/256, 355/200, 210, 215, 326, 327; 430/45, 47, 131, 132, 97, 117

[56] References Cited

U.S. PATENT DOCUMENTS

| | | | |
|---|---|---|---|
| 3,806,340 | 4/1974 | Sato et al. | 430/45 |
| 4,277,551 | 7/1981 | Sonnonstine et al. | 355/211 X |
| 4,538,899 | 9/1985 | Landa et al. | 355/292 X |
| 4,660,503 | 4/1987 | Jones | 118/652 X |

*Primary Examiner*—A. T. Grimley

*Assistant Examiner*—Christopher Horgan

*Attorney, Agent, or Firm*—Robert L. Randall

[57] ABSTRACT

An improvement in the method and apparatus for producing a multi-color electrophotographic image wherein an electrophotographic medium is mounted on a carrier therefor and is translated over a predetermined path so that the medium is first charged, then exposed to a first light-borne image and then toned. Thus, the unexposed portions of the image bearing charged region of the medium are toned, preferably by a liquid toner, to produce a first color visible image. The carrier is then returned to the first position to repeat the foregoing steps to charge the medium and to expose it to a second light-borne image and to tone the second image with a second toning element to produce a second color visible image on the same sheet of medium. The improvement comprises means for applying a solvent vapor to the surface of the first toned image after the first toning step and prior to the second charging step to smooth and further fuse the previously toned image to prevent color contamination of subsequent imaging cycles.

9 Claims, 3 Drawing Sheets

METHOD AND APPARATUS FOR IMPROVING A MULTI-COLOR ELECTROPHOTOGRAPHIC IMAGE USING VAPOR FUSING

CROSS-REFERENCE TO RELATED APPLICATIONS

The present invention relates to means for improving an electrophotographic image and is related to the improvements disclosed and claimed in copending applications Ser. No. 358,916, Apparatus for Improving a Multi-color Electrophotographic Image in the names of Lawrence C. Steele and Kenneth E. Rook, Ser. No. 358,918, Method of Improving a Multi-color Electrophotographic Image in the names of Lawrence C. Steele and Kenneth E. Rook, and Ser. No. 358,101, Method of Improving a Multi-color Electrophotographic Image by Buffing an Image Toned with an Improved Toner, in the names of Lawrence C. Steele, Kenneth E. Rook, Domenic Santilli, and Dennis R. Kamp, all filed on May 26, 1989, and Ser. No. 500,431, Method and Apparatus for Improving a Multi-color Electrophotographic Image Using Heat Fusing in the name of Lawrence C. Steele, filed on even date herewith.

BACKGROUND OF THE INVENTION

1. Field of the Invention

This invention relates to electrophoretic liquid development and more particularly to an improved process of plural stage development.

2. Description Relative to the Prior Art

In the liquid development of electrostatically charged latent images, as in electrophotography and in other processes that form and develop electrostatic charge patterns, a substrate having a charge pattern on its surface is contacted with a liquid developer which is essentially a suspension of colloidal toner particles in an insulating liquid. Liquid developers normally also contain a stabilizer or charge control agent. The latter is an ionic compound which controls the magnitude of the charge on the toner particles and aids in maintaining a stable charge on the toner particles within the insulating carrier liquid.

Liquid developers can be used in single stage or plural stage development processes. Examples of the latter may include the sequential development on a photoconductor of two or more color-separation images, the annotation of a previously developed image, or the repeated re-exposure and development of images on a reusable photoconductor, with transfer of images upon completion of a number of imaging cycles.

In certain plural stage development processes which use liquid developers, a problem has been found which is especially significant in processes for the electrophotographic reproduction of multi-color images of graphic arts quality. In these processes electrostatic latent images are formed sequentially on a chargeable substrate such as an electrophotographic medium, with liquid development or toning of each latent image before the next image is formed. A leading example of this type of system involves processing an electrophotographic medium sequentially through a series of four imaging cycles including four sequential development or toning stages.

While the present invention is useful in any electrostatic imaging process wherein a charge pattern is formed and developed with a liquid developer on a surface which has previously been developed with a liquid developer, it is particularly useful in combination with a recently developed electrophotographic process of making lithographic color proofs, such as described in U.S. Pat. No. 4,600,669. In that process a photoconductor, which has a uniformly charged thin transparent dielectric overlayer, is subjected to a series of exposures through registered color separation transparencies. After each exposure the dielectric layer is developed with a liquid developer, and the surface is again uniformly charged, exposed, and developed. The sequence is repeated for each of the color transparencies, usually four. It has been found that image defects occur in areas of the image which are toned areas of a previous imaging cycle. The defect appears as a color contamination of the previously toned areas which imparts a non-uniform density, thereby altering color rendition, a defect which, though perhaps acceptable in some kinds of add-on, plural stage imaging, is not acceptable for producing high quality images as required, for example, in the graphic arts field.

It has been discovered that the described image defects in plural-stage liquid development appear to be caused by the presence of forces, substances, or charge acceptance in the previously toned areas that interfere with the correct subsequent development in those areas. Although the nature of those forces or substances is not clear, the present invention provides apparatus that reduces or eliminates the problem.

U. S. Pat. No. 4,660,503 describes the improvement in the process of the '669 patent of cleaning the image by brushing the surface of the toned image with a soft, smooth, and supple fibrous brush member between the development of an image and the exposure of the next image to remove counterion material from the untoned areas which interferes with subsequent toning cycles in the above-mentioned process. The improvement of the '503 patent affects only the untoned areas of the developed substrate or photoconductor and has been found to have no effect on the toned areas where the present problem has been found.

Thus, the problem addressed by the present invention is that of preventing color contamination of previously toned areas rather than preventing contamination of the untoned areas. The solution must not adversely affect the desired electrophoretic deposition of toner particles in both previously toned and untoned areas to develop the latent electrostatic image areas of subsequent imaging cycles. The above-referenced, previously filed copending applications are directed to a method and apparatus for preventing the contamination of previously toned areas by physically smoothing the toned image before generating the subsequent image, such as by buffing with a rotating brush.

Accordingly, the provision of an additional simple and relatively easily implemented solution to this problem, particularly if it can be done at a nominal cost and does not have any significant negative effects on the resulting image, would be very advantageous in providing a variety of solutions from which to choose.

SUMMARY OF THE INVENTION

The present invention thus provides a method and apparatus for producing a multi-color electrophotographic image that enhances the image quality by preventing the small toner particles of liquid developers from adhering to previously toned areas unless electrostatic latent image fields are present to support such deposition.

According to one aspect of the present invention, apparatus for producing a multi-color electrophotographic image is provided which comprises means for providing an electrophotographic medium on a carrier therefor at a first position, means for translating the carrier and medium together over a predetermined path, means for charging the medium at a second position, and means for exposing the medium to a first light-borne image at a third position. Means is provided for toning the image to produce a first color visible image. Means is provided for returning the carrier and medium to the first position to repeat the foregoing steps to charge the medium and to expose it to a second light-borne image and to tone the second image with a second toning element to produce a second color visible image. The improvement of the present invention comprises means for applying a solvent vapor to the image following the first toning step and prior to the second charging step.

According to another aspect of the present invention, it has been found that applying a vapor of a solvent for the toner binder to the surface of the toner on the electrophotograhic medium provides the desired level of smoothness and fusing characteristics.

According to yet another aspect of the present invention, the source of vapor comprises means for applying the toner binder solvent vapor to the surface of the toned image which means is mounted transversely of the direction of movement of the carrier.

According to still another aspect of the present invention, the vapor source is arranged to direct heated solvent vapor toward said image.

According to a further aspect of the present invention, a method of producing a multi-color electrophotographic image is provided which comprises the steps of mounting an electrophotographic medium on the carrier and translating the carrier and medium together over a predetermined path, charging the medium and exposing the medium to a first light-borne image, and developing the image to produce a first color visible image. The carrier and the medium are then returned to the starting position to repeat the foregoing steps to charge the medium and to expose it to a second light-borne image and to tone the second image with a second toning element to produce a second color visible image. The surface of the image is cleaned following development and prior to the second charging. The improvement comprises the step of applying the vapor to the surface of the image toner binder solvent immediately following the cleaning step and prior to the second charging step to thereby smooth any previously toned areas and minimize unwanted toner particle adherence.

Various means for practicing the invention and other features and advantages thereof will be apparent from the following detailed description of an illustrative preferred embodiment of the invention, reference being made to the accompanying drawings.

DESCRIPTION OF THE PREFERRED EMBODIMENTS

Although the present invention is applicable to various electrophotographic elements, methods and apparatus, the embodiment to be described is directed to a multi-color electrophotographic image producing apparatus employing an electrophotographic medium of the type disclosed in the above-identified '669 patent.

Figure 1:
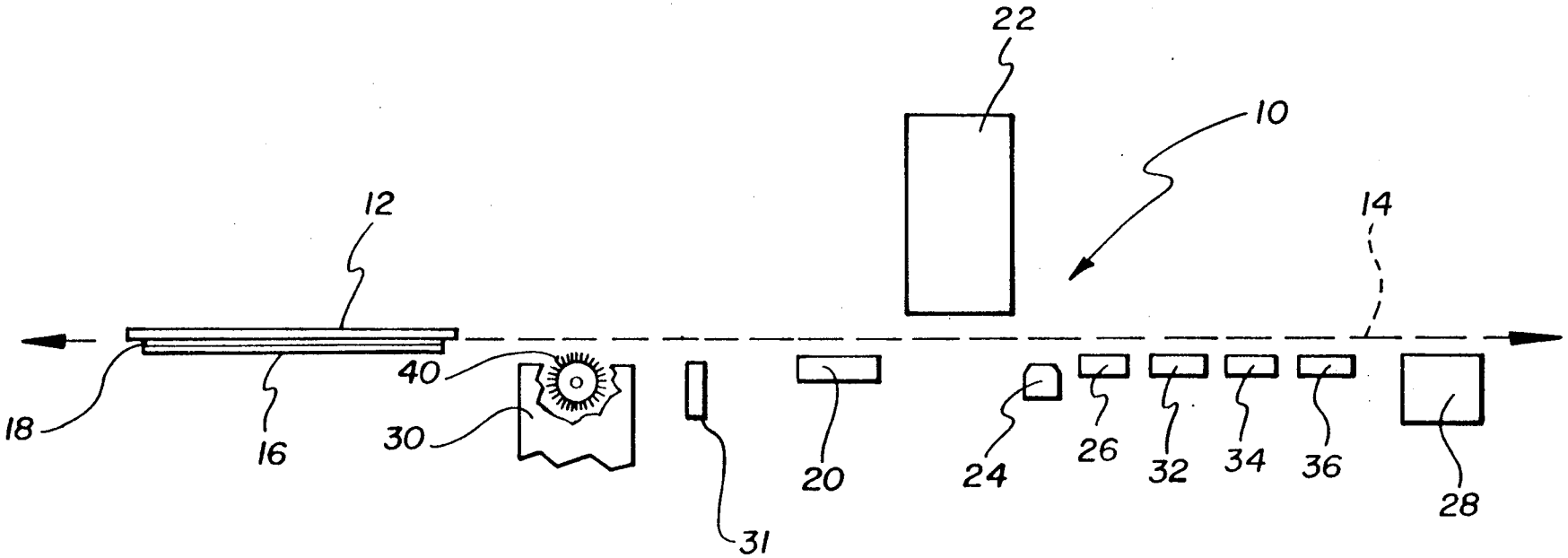
FIG. 1 is a schematic illustration of apparatus for producing a multi-color electrophotographic image in accordance with the present invention.

A schematic illustration of a multi-color electrophotographic image processor 10 is illustrated in FIG. 1 and consists of a carrier or platen 12 which is movable along the processing path, represented by dotted line 14, past the respective processing stations of the apparatus, to be described hereinafter. The path 14 may be determined by guide rails or other structure of the apparatus in a manner well-known in the art whereby the platen may move from a starting position, illustrated, to the right-most position and then returned to the left to the starting position. The platen 12 is preferably transparent and is provided with means, not shown, for retaining an electrophotographic medium 16 on the lower surface thereof with an image-bearing transparency 18 disposed therebetween which is used to generate the image in the electrophotographic medium 16, in a manner more thoroughly described hereinbelow.

As noted in the above-cited '669 patent, the electrophotographic medium comprises a photoconductive layer on an electrically conducting substrate which is capable of transmitting actinic radiation to which the photoconductive layer is responsive. A dielectric support is releasably adhered to the substrate and comprises the photoconductive layer or an overcoat thereof which forms an outer surface of the element capable of holding an electrostatic charge. To use the element, the surface of the dielectric support is charged and the photoconductive layer is image-wise exposed to the actinic radiation, thereby forming a developable electrostatic image on the dielectric surface. The electrostatic image in turn is developed with a toner to form a first color image. A composite color image can be formed on the element by repeating the sequence one or more times with image-wise exposure of the photoconductive layer to actinic radiation transmitted through the transparent support, and developing over each preceding image with a different color toner. The composite toned image is then transferred with the dielectric support to a receiving element to form a color copy which may be a color proof closely simulating the color print expected from a color print press.

Accordingly, the electrophotographic medium 16 is mounted onto the platen 12 with the transparency original 18, which may be a color separation representing a color to be printed, sandwiched therebetween. The electrophotographic medium 16 and the transparency original 18 may be held to the platen 12 by any suitable means known in the art such as a vacuum clamp whereby they are maintained in close proximity to assure satisfactory exposure, processing and register. Further, the electrophotographic medium must also be suitably grounded to the apparatus to enable the charging process to be satisfactorily carried out. A number of grounding means are known in the art and will not be described herein. As the platen 12, with the original and the electrophotographic medium 16, is translated to the right (in FIG. 1), the dielectric support of the electrophotographic medium is given an overall charge via a charging means 20, such as a corona charger, to form a uniform potential on the surface of the dielectric support. Upon being so charged the electrophotographic medium is image-wise exposed by passing beneath an exposure lamp apparatus 22 which projects light through the transparent platen 12, the transparency original 18, and through the transparent conductive substrate of the electrophotographic medium. When the photoconductive layer is thus image-wise exposed, mobile charge carriers, in this case positively charged holes, are formed in the photoconductive layer and migrate towards the interface of the photoconductive layer and the conducting layer as described in the '669 patent. Accordingly, the electric field strength in exposed regions is diminished while the field strength in unexposed regions remains approximately the same. As a result, an electrostatic differential pattern is formed on the dielectric support corresponding to the pattern on the transparency original.

The platen continues its movement, to the right in FIG. 1, passing over a pre-rinse head 24 which is fixed in position whereby the fluid head provided thereat when activated contacts the lower surface of the electrophotographic medium as it passes in the processing direction, i.e., to the right, but does not contact the medium when the fluid head is inactivated as when the platen is moved to the left in FIG. 1, to the original position. The pre-rinse head prewets the medium with a dispersant dielectric liquid prior to the liquid toning step. Thereafter, the platen moves past a raised first liquid toning station 26 which is raised into operating position whereby the lower surface of the electrophotographic medium is contacted and a toner image is imparted thereto, in a manner well-known in the art. In this system, the liquid toner is deposited in the unexposed, still charged area of the electrophotographic medium thereby forming a positive image which is a duplicate of the image carried by the transparency 18. It is also well-known in the art to produce negative images with similar electrophotographic processes wherein the charges imparted to the electrophotgraphic medium and the toners are appropriately adjusted to give a negative image. The platen continues movement to the right in the illustration, past appropriate rinse heads and dryers, not shown. The last station 28 at the right end of the apparatus is an erase lamp that exposes the electrophotographic medium after the toning operation to expose those parts of the photoconductive layer that were not exposed by the original image exposure so that the entire electrophotographic medium has substantially the same exposure history.

The platen 12 is then reversed and is returned to the starting position illustrated in FIG. 1. At this point the electrophotographic medium 16, while still engaged along one edge to the platen to maintain registry for subsequent exposures, is moved away from the platen to a substantially vertical position and the first original transparency or color separation 18 is removed and replaced by a second transparency or color separation. The electrophotographic medium is returned to the platen in registry with the second transparency ready for the next pass through the apparatus to generate the second color image. When the electrophotographic medium 16 and the next original sheet 18 are re-registered on the platen 12, the platen is moved to the right again for charging, exposure, and subsequent toning. However, the platen first passes over a cleaning station 30 which includes a rotating brush member 40. This cleaning station and its operation are described in the above-referenced '503 patent. When the cleaning station is raised into operative position with respect to the electrophotographic medium surface, the brush bristles engage the toned image and lightly clean it. The platen then moves to a vapor applying station 31 which forms the improvement of the present invention. The construction and operation of the vapor applying station are more thoroughly described hereinbelow.

The platen then moves to the charging station 20 where the electrophotographic medium is again charged and then moves to the exposure position 22 where light again is projected through the platen and the second color separation 18 to selectively discharge the photoconductive layer in accordance with the transparancy or color separation then in contact with the electrophotographic medium. Thereafter, the platen moves the electrophotographic medium to the pre-rinse station 24 and then to a second toning station 32 which is then in operative position to tone the surface of the electrophotographic medium with a second color toner to produce a second color visible image overlying the first image. The platen subsequently moves past the aforementioned rinse and drying stations and again past the erase exposure station 28 before being returned to the starting position at the left-hand end of the apparatus. Should it be desired to create a four color image (or a three color plus black image), the charging, exposing, and toning steps will be repeated for two more color separation originals with the platen and electrophotographic medium being moved into operative contact with an additional two toning stations 34 and 36, one for each of the additional colors. Prior to each of these additional exposing and toning steps, the cleaning and vapor applying stations 30 and 31 are raised into operative position with respect to the surface of the electrophotographic medium as the platen begins its travel to the right to again clean and apply the solvent vapor to the toned medium to both remove toning materials from the untoned portions thereof without significantly altering the toned image and then to smooth the toned image, as will be further described hereinbelow. It will be appreciated that, as known in the art, the toning order may not necessarily be represented by the physical order of the toning stations in the apparatus, and the order given above is by way of example only.

After the final toning, rinsing, and drying steps, the platen 12 is returned to the first position where the electrophotographic medium is removed. On the final return of the platen the cleaning brush 40 is again raised into the operative position to clean the final image. In keeping with the desire to rotate the cleaning brush in a direction counter to the direction of travel of the electrophotographic medium, the brush is rotated in a clockwise direction (as viewed in FIG. 1) for this operation. While there are no additional toning operations to be conducted on the medium at this point, it has been found that the final brushing step aids in the lamination of the image-bearing release layer of the film to the paper stock, minimizing artifacts that have been found to occur without this final brushing operation.

Figure 2:
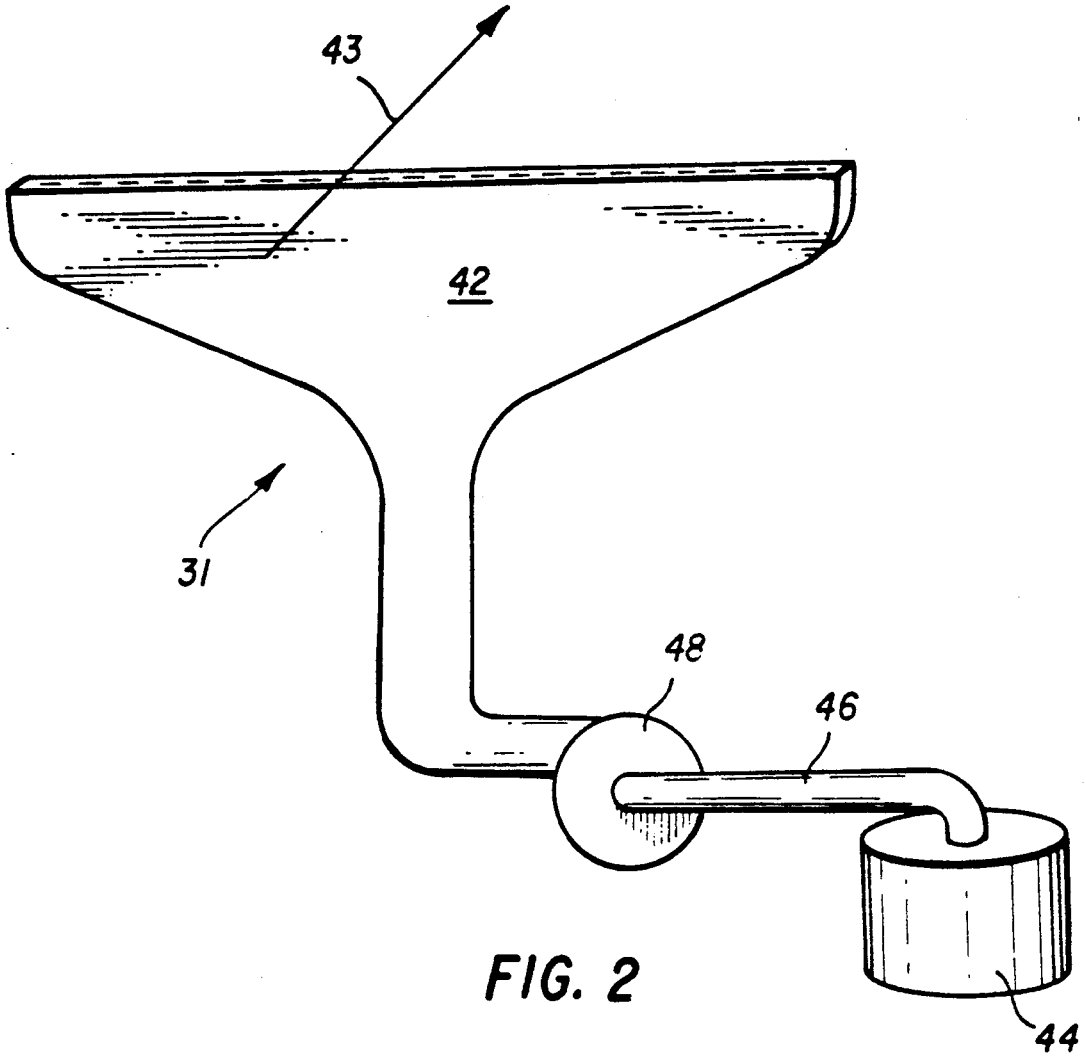
FIG. 2 is a perspective view of means for applying vapor to the toned surface for use in the present invention.

While the other components of the electrophotographic apparatus described herein are known in the art, the vapor applying station assembly 31 is described in further detail with respect to FIG. 2. As illustrated, the vapor applying station assembly takes up little additional space along the travel length of the apparatus, being only wide enough to mount a vapor applying nozzle 42 with the ancillary components being remotely located. In the embodiment illustrated, the vapor applying station comprises, in the preferred embodiment, the nozzle 42 which is disposed transversely of the travel of the platen (as indicated by arrow 43) and having a length substantially equal to the width of the platen. The vaporized toner binder solvent is provided by a tank of the solvent 44. The tank is connected via a conduit 46 to the nozzle 42. If necessary, the tank may be provided with a heater (not shown) to vaporize the solvent. Further, if necessary, a fan 48 may be provided in the conduit to provide the necessary volume of vapor to the surface of the medium. It has been found that the application of the solvent vapor to the toned surface apparently causes the toner to fuse and, as a result, become smoother, resulting in less unwanted toner from subsequent toning steps from adhering thereto.

The solvent vapor is selected from those which are solvents for the toner binder. Included in this group are dichloromethane, 1,1 dichloroethane, 1,2 dichloroethane, 1,1,2 trichloroethane, 1,1,1 trichloroethane, ethylacetate and tolulene having boiling points ranging from 40° C. to 84° C. Preferably, the solvent has a low boiling point, reducing or eliminating the necessity of heating the solvent to obtain the vapor.

ALTERNATIVE EMBODIMENTS

Figure 3:
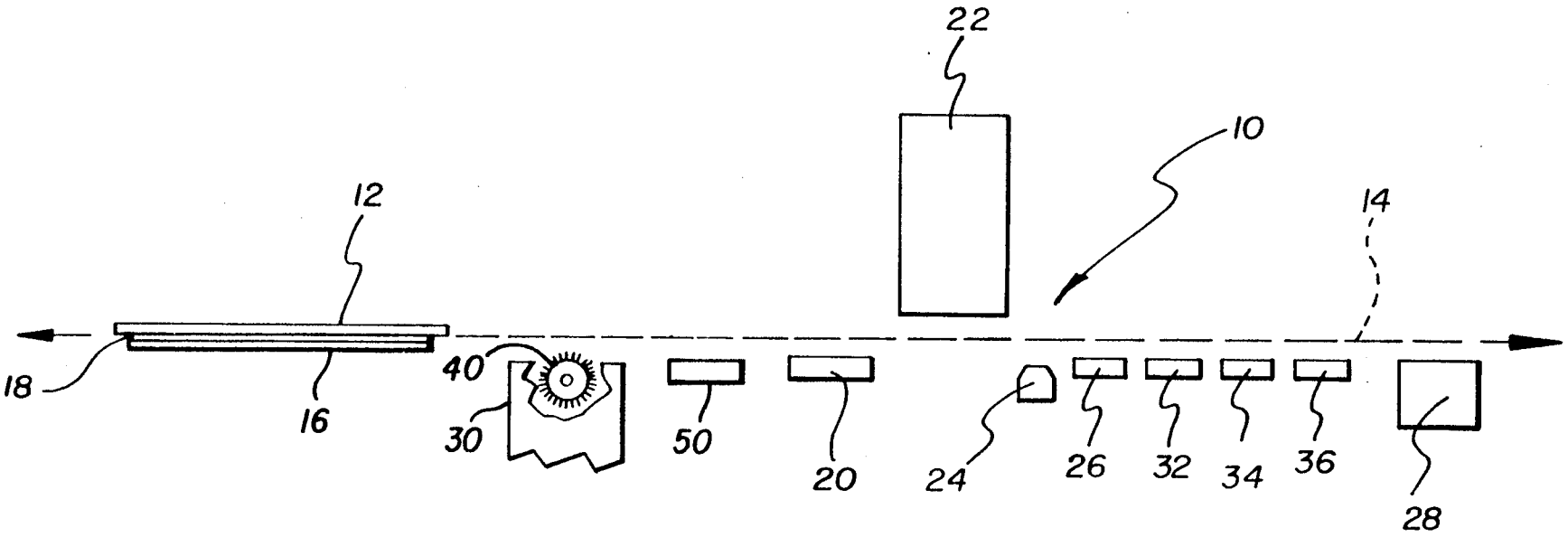
FIG. 3 is a schematic illustration of apparatus for an alternative embodiment of the present invention.

An alternative embodiment may be used which merely employs a tray 50 of heated solvent which is opened to the electrophotographic medium at the appropriate time as illustrated in FIG. 3.

Other alternate embodiments include the use of a venting hood of exhaust fan should it be necessary to remove excess vapors from the apparatus.

By applying the solvent vapor to the developed image in accordance with the present invention, it has been found that the toned image areas are prevented from becoming contaminated, such as by having their color rendition altered, as subsequent images are produced, apparently by preventing the small toner particles of the liquid developer from adhering to the portions of the previously toned areas which are not imaged in the current imaging step. Although we do not wish to be bound by any theoretical explanation of the mechanism of the present invention, a possible explanation for the results observed is that the application of the solvent vapor to the developed photoconductor smoothes any previously toned areas thereby minimizing unwanted toner particle adherence. It may be that the vapor fuses the toned image areas and smoothes the microstructure of the toned image so that there is less surface roughness to which stray toner particles can adhere.

The brushing and vapor applying steps together provide for the removal of counter-ions and backround density in the untoned areas by the brushing step and the prevention of color contamination in the toned image areas by smoothing the toner surface with the vapor applying step. While the vapor applying station has been disclosed as being preferably located between the cleaning station and the charging station, it will be appreciated that it can also be located along with the cleaning station to the right of the erase lamp 28. The only necessity is that the vapor applying step be accomplished after the cleaning step, if the cleaning step is used. The location of the cleaning and vapor applying stations between the loading position and the charging station provides the advantage that the toned electrophotographic medium has had the maximum opportunity to dry prior to cleaning and the application of the vapor without necessitating an unduly long waiting time. However, if time is not of the essence then the platen can be arranged to stop prior to the brushing and vapor applying assemblies to the right of the erase exposure lamp, so that the toned image is sufficiently dry to permit brushing and the application of vapor at that location.

It will be appreciated that the present invention thus provides an improved method and apparatus for producing a multi-color electrophotographic image that enhances the image quality by preventing small toner particles of the liquid developers from adhering to previously toned areas, which causes altered color rendition, unless that area has been imaged during the current imaging cycle. Moreover, the present invention provides a simple and relatively easily implemented solution to this problem at a nominal cost and without any significant negative effects on the resulting image. Still further, it has been found that the use of the present invention does not adversely affect the ability to transfer the final multi-color image to a paper substrate.

The invention has been described with reference to specific embodiments and variations, but it should be apparent that other modifications and variations can be made within the spirit and scope of the invention, which is defined by the following claims.

What is claimed is:

1. In an apparatus for producing a multi-stage electrophotographic image comprising means for providing an electrophotographic medium on a carrier therefor, means for translating the carrier and medium together over a predetermined path, means for charging the medium, means for exposing the medium to a first light-borne image, means for toning the image bearing charged region of the medium to produce a first color visible image, and means for returning the carrier to the starting position to repeat the foregoing steps of charging said medium, exposing it to a second light-borne image and toning said medium to produce a second visible image, the improvement comprising means for treating the surface of the first toned image after said first toning step and prior to said second charging step with a toner binder solvent vapor to smooth the toned image and prevent unwanted toner particles from adhering to the first toned image.

2. The apparatus according to claim 1 wherein said treating means comprises container means for holding said solvent, means for vaporizing said solvent, and means for conducting said vapor from said container means to said medium.

3. Apparatus for producing a multi-color electrophotographic image comprising means for providing an electrophotographic medium on a carrier therefor, translating the carrier and medium together over a predetermined path, means for charging the medium, means for exposing the medium to a first light-borne image, means for toning the image bearing charged region of the medium to produce a first color visible image, and means for returning the carrier to the starting position to repeat the foregoing steps of charging said medium, exposing it to a second light-borne image and toning said second image with a second toning element to produce a second visible image, and means for cleaning the untoned portions of the medium between the toning of the first image and the second charging step, the improvement comprising means for applying a toner binder solvent vapor to the surface of the first toned image after said medium has been cleaned and prior to the second charging step thereby smoothing any previously toned areas and minimizing unwanted toner particle adherence.

4. The apparatus according to claim 3 wherein applying means comprises a nozzle means arranged to direct said vapor to the toned surface disposed along said predetermined path between said cleaning means and said charging means.

5. The apparatus according to claim 3 including means for actuating said vapor applying means after the first three toning steps.

6. The apparatus according to claim 3 including means for actuating said vapor applying means after each toning step.

7. In a method for producing a multi-stage electrophotographic image comprising the steps of providing an electrophotographic medium on a carrier therefor, translating the carrier and medium together over a predetermined path, charging the medium, exposing the medium to a first light-borne image, toning the image bearing charged region of the medium to produce a first visible image, and returning the carrier to the first position to repeat the foregoing steps of charging said medium, exposing it to a second light-borne image and toning said second image with a second toning element to produce a second visible image, the improvement comprising the step of applying a toner binder solvent vapor to the surface of the first toned image to prevent unwanted small toner particles from adhering to the first toned image.

8. The method of producing a multi-stage electrophotographic image according to claim 7 including the step of selecting the toner binder solvent from the group consisting of dichloromethane, 1,1 dichloroethane, 1,2 dichloroethane, 1,1,2 trichloroethane, 1,1,1 trichloroethane, ethylacetate and tolulene.

9. In the method of producing a multi-stage electrophotographic record in which successively formed electrostatic images of predetermined polarity are sequentially developed in superposition on an electrophotographic medium with electroscopic toner, the improvement comprising the step of applying a toner binder solvent vapor to the surface of the developed image after a development step and prior to the next charging step to prevent unwanted small toner particles present in liquid toner from adhering to the first toned image and thereby contaminating the first toned image.

* * * * *